United States Patent [19]

Gruber

[11] Patent Number: 4,629,124

[45] Date of Patent: Dec. 16, 1986

[54] SHOWER

[75] Inventor: Walter F. Gruber, Stuttgart, Fed. Rep. of Germany

[73] Assignee: Hansa Metallwerke AG, Stuttgart, Fed. Rep. of Germany

[21] Appl. No.: 715,268

[22] Filed: Mar. 25, 1985

[30] Foreign Application Priority Data

Apr. 11, 1984 [DE] Fed. Rep. of Germany ..... 3413552

[51] Int. Cl.[4] ..... B05B 7/00

[52] U.S. Cl. ..... 239/428.5; 239/447; 239/448; 239/562; 239/586; 239/590.3

[58] Field of Search ..... 239/312, 396, 428.5, 239/436, 443–449, 562, 563, 586, 590.5, 590.3; 4/542, 543

[56] References Cited

U.S. PATENT DOCUMENTS 904,243 11/1908 Bennett ..... 239/444 X
4,211,368 7/1980 Legros et al. ..... 239/428.5 X

FOREIGN PATENT DOCUMENTS 1114445 9/1961 Fed. Rep. of Germany ..... 239/447
2821195 11/1979 Fed. Rep. of Germany ... 239/428.5
3006660 8/1981 Fed. Rep. of Germany ..... 239/448
2481954 11/1981 France ..... 239/447

*Primary Examiner*—Joseph F. Peters, Jr.
*Assistant Examiner*—Mary Beth O. Jones
*Attorney, Agent, or Firm*—Fred Philpitt

[57] ABSTRACT

A hand shower, for optional hard-jet and soft-jet operation in which the water paths provided for the hard-jet and soft-jet operations extend behind a change-over device completely separately from each other. In the water path associated with the soft-jet operation there is arranged a central device for enriching the through-flowing water with air, the area of which device is small compared to the entire outlet area of the water on the perforated plate of the shower. Both the water enriched with air and the water intended for the hard-jet operation are guided via a water distribution chamber; the two water distribution chambers communicate with two separate sets of outlet ports in the perforated plate of the shower (FIG. 4).

13 Claims, 4 Drawing Figures

SHOWER

The invention relates to a shower provided with a housing, which terminates in a bell-shaped end part shut by a perforated plate, and with a change-over device for optional hard-jet and soft-jet operation and with a device which, in the soft-jet operation, enriches the through-flowing water with air.

There is known a hand shower which allows either hard or soft jets of water, which are interspersed with air bubbles, to emerge optionally from a plurality of water outlet ports in the perforated plate. The hard-jet to soft-jet operation change-over is effected in that a plate, which is arranged upstream of the perforated plate in the flow direction, is rotated. This rotation allows a set of holes which are covered with sieves and produce a soft jet in this way or a set of through holes, which are not covered with sieves, to be optionally brought in front of the water outlet ports in the head plate. In this construction, the hard-jet and soft-jet water paths are the same. The device enriching the through-flowing water with air has an area which is virtually identical with the area of the perforated plate; it is thus relatively large and expensive. Since the hard-jet and soft-jet outlet ports in the perforated plate are the same, thus agreeing in number, the quantity of water emerging in both modes of operation is substantially identical upon a simple change-over (without any quantity re-adjustment). This results in that when the hard-jet quantity setting, which is pleasant for the user, is changed to the soft jet there no longer occurs any effective bubble formation of the water jets. When, conversely, the quantity of water in the soft-jet operation is so set that there comes about an effective interspersion of the jets of water with air, the hard jets become too hard for the user in the hard-jet operation.

In the earlier West Germans Patent Application No. P 33 35 756.0, which has not been published previously, it is proposed to use a plurality of standard air bubblers for bringing about the soft jets. This construction is indeed relatively inexpensive but has the disadvantage that the number of the soft jets is limited and that it is difficult to bring about therewith the shower image to which the user is accustomed.

It is the object of the present invention to develop a shower of the kind mentioned at the beginning so that the device enriching the water with air in the soft-jet operation can be further simplified and designed more cheaply.

According to the invention, this problem is solved in that (a) the change-over device guides the inflowing water optionally to one of two completely separated water paths;
(b) each water path comprises a water distribution chamber which extends substantially parallel to the perforated plate;
(c) each water distribution chamber is in communication with a separate set of outlet ports in the perforated plate;
(d) the device enriching the water with air is arranged substantially centrally in the water path to be associated with the soft-jet operation upstream of the water distribution chamber and has a small area compared to the water outlet area of the perforated plate.

The invention is based on the realisation that, contrary to the hitherto generally accepted assumption that the soft jets have to leave the device enriching the water with air in a straight line, there does not occur a separation of water and air in the soft-jet operation even if the water is deflected once or several times inside the shower. The invention therefore provides, for the soft-jet operation, for a central, relatively small-area and therefore low-cost device for enriching the water with air, from which, in the soft-jet operation, the water is "fanned" on the outlet surface corresponding to the perforated plate via a water distribution chamber. The term "central" does not necessarily mean "in the centre" here, although this geometrical arrangement is in general expedient. "Central" is supposed to mean only that the enrichment with air is, as it were, "centralised" inside the shower, in other words, that it is concentrated on a relatively small device.

The change-over device comprises expediently a two-way valve cone.

The shower can be particularly favourably constructed geometrically if one of the two water distribution chambers directly adjoins the perforated plate and if the other water distribution chamber is separated from the first water distribution chamber by a chamber divider and is at a distance from the perforated plate and if there is provided a plurality of flow sleeves which pass through the first water distribution chamber and establish a connection between the second water distribution chamber and the outside of the perforated plate.

The flow sleeves may be integrally formed with the chamber divider.

According to a particularly important feature of the invention, the flow sleeves project, with a free end, respectively into a hole in the perforated plate, the diameter of the free end being smaller than the diameter of the hole in the perforated plate so that there comes about an annular clearance within the hole in the perforated plate, via which water can emerge from the first water distribution chamber. In this way, the water outlet ports forming part of the first "set" as defined above concentrically surround the water outlet ports to be associated with the second "set". The two "sets" thus comprise the same number of water outlet ports in very similar geometrical patterns so that, to the eye, the position of the individual water jets is substantially unchanged when a change from the hard-jet operation to the soft-jet operation is effected. Nevertheless, the outlet ports in the two "sets" may be given different cross-sections so that there does not emerge the same quantity of water in the soft-jet and hard-jet operations.

In the central zone, the chamber divider can be supported on the perforated plate via an annular wall provided with several passage ports.

The device enriching the water with air is expediently arranged in a hole in an insert and communicates via a radial air suction channel with an annular clearance between the insert and the housing, which clearance, for its part, is in communication with the outside atmosphere.

The device enriching the water with air may be a standard air bubbler. Such air bubblers are produced in extremely large quantities and are relatively inexpensive. In addition, they can be easily exchanged at any time.

The air bubbler may be supported by a cylindrical collar of the chamber divider which projects into the hole in the insert.

However, the device enriching the water with air may just as well be a perforated plate which passes through the hole in the insert. Surprisingly, it has turned out that such a perforated plate, which may be integral with the insert, is quite adequate for attaining the desired soft-jet effect. It goes without saying that this design of the device enriching the water with air is particularly inexpensive.

If a cylindrical collar of the chamber divider projects into the hole in the insert and ends a short distance from the perforated plate, there comes about an injector effect which enhances the enrichment of the through-flowing water with air.

Hereinafter, some exemplified embodiments of the invention will be explained in detail with reference to the drawings, in which.

Figure 1:
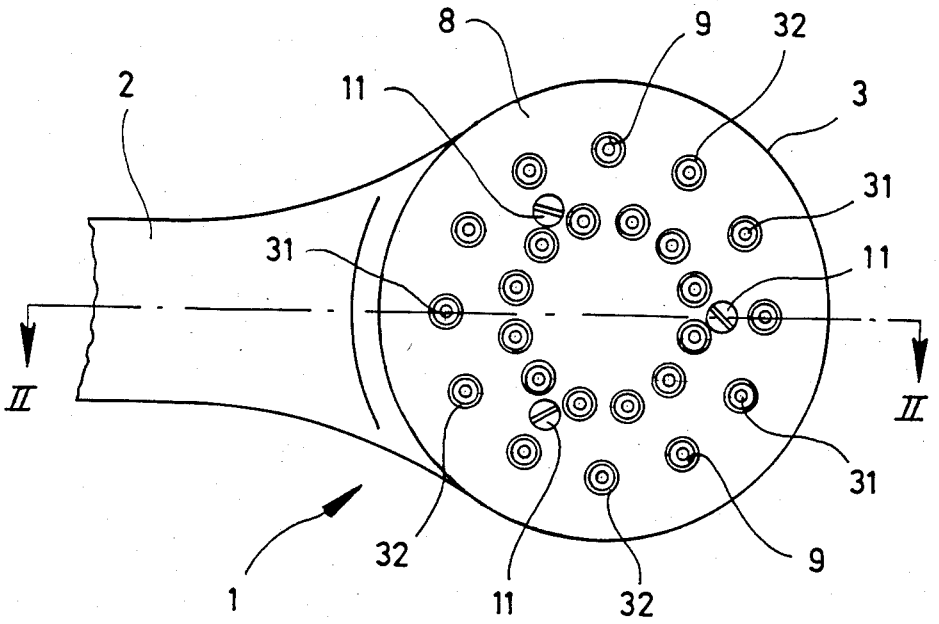
FIG. 1 shows the water outlet side of a hand shower (the handle zone has been broken away)

The hand shower shown in the drawings comprises in known manner a plastics-material housing 1 which extends from a handle 2, which is only partly shown, and terminates in a bell-shaped end part 3. The handle 2 encloses a water admission chamber 4.

Into the inside chamber of the bell-shaped end part 3 there has been placed an insert 5 which is sealed against the walls of the housing 1 by two O-rings 6, 7. The insert 5, which will be described in detail below, is held in the housing 1 by a perforated plate 8 which is provided with a plurality of holes 9. Furthermore, a chamber divider 10 has been clamped between the perforated plate 8 and the insert 5. The chamber divider 10 will also be described in detail below. The perforated plate 8, the chamber divider 10 and the insert 5 are fixed to the housing 1 by three screws 11 which, sealed with the aid of O-rings, are passed through the chamber divider 10 and the insert 5.

In the central zone of the insert 5 (FIG. 2), there is provided a downwardly widening stepped hole 12, into which a standard air bubbler 13 has been introduced from the bottom. The air bubbler 13 bears against the annular shoulder of the stepped hole 12 at the top and against a cylindrical collar 14 of the chamber divider 10 at the bottom, which collar engages in the wider zone of the stepped hole 12 and is sealed against the wall thereof with an O-ring.

A radial air suction channel 21 radially connects the stepped hole 12 in the zone of the air bubbler 13 to the circumference of the insert 5 and from there to the ambient atmosphere via the annular clearance 22 located between the circumferences of the insert 5 and the perforated plate 8, on the one hand, and the housing 1, on the other hand.

Axially parallel to the stepped hole 12, there is provided, offset in the direction of the handle 2, a second stepped hole 15 in the insert 5, the wider zone of which communicates with the water admission chamber 4 via a radial channel 16. The annular shoulder of the stepped hole 15 forms a first valve seat for a two-way valve cone 17. The second valve seat, with which the two-way valve cone 17 co-operates, is formed by a valve seat part 18 which is placed from the top into the wider zone of the stepped hole 15, is sealed radially against this zone by an O-ring and is pressed against a shoulder of the housing 1 by the insert 5. A hole 19 passing through the valve seat part 18 extends coaxially with the stepped hole 15 and has the same diameter as the narrower zone of the stepped hole 15.

The inside chamber of the bell-shaped housing end part 3 has been so recessed that there comes about an overflow chamber 20 which connects the upper end of the hole 19 in the valve seat part 18 to the upper end of the stepped hole 12 in the insert 5.

At the lower front end, the insert 5 has been so recessed that a first water distribution chamber 23 comes about between it and the chamber divider 10.

The two-way valve cone 17 is actuated via a valve stem 24 which is passed through a hole in the housing 1 in a sealed manner and ends in a round head 26. The head 26 of the valve stem 24 has been pressed elastically into a corresponding reception port on the underside of an actuating member 27. The actuating member 27 has been put over a collar 28 of the housing 1, which has been integrally moulded thereon, and can carry out a rocker-like movement around upwardly projecting zones 29 of the collar 28.

In addition to the above-mentioned collar 14, the chamber divider 10 has a plurality of integrally moulded-on flow sleeves 30 which, with a narrow cylindrical neck 31*a*, extend into the holes 9 in the perforated plate 8. The diameter of the neck 31*a* of the flow sleeves 30 is somewhat smaller than the diameter of the holes 9 in the perforated plate 8 so that an annular clearance 32 comes about between each hole and the neck 31*a*, which is arranged therein, of the corresponding flow sleeve 30.

The chamber divider 10 is supported not only on the edge but also on the central zone of the perforated plate 8 by an annular wall 33, in which a plurality of passage ports 34 establish a connection between the stepped hole 12 zone located beneath the air bubbler 15 and a water distribution chamber 35 located between the chamber divider 10 and the perforated plate 8 and penetrated by the flow sleeves 30.

The possible water paths inside the described hand shower and the mode of operation thereof are/is as follows:-

Figure 2:
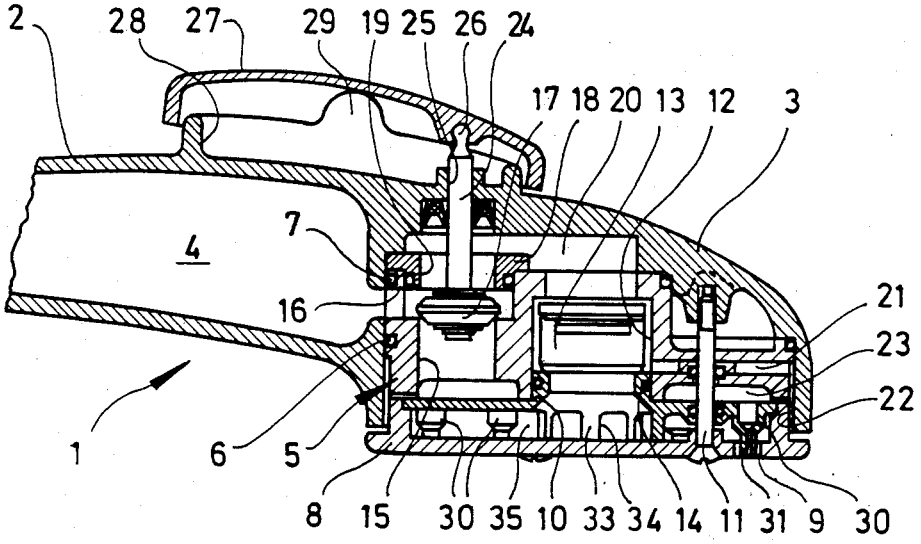
FIG. 2 shows a section according to the line II—II of FIG. 1.

In the position of the two-way valve cone 17 shown in FIG. 2, the hand shower has been set to the soft-jet operation. The water flows from the admission chamber 4 via the radial channel 16 into the wider zone of the stepped hole 15 and from there via the hole 19 in the valve seat part 18, the overflow chamber 20 and the narrower zone of the stepped hole 12 to the air bubbler 15. There, it is enriched with air which is fed from the ambient atmosphere to the air bubbler 13 via the suction channel 21 and the gap 22.

The bubbling water enriched with air flows into the collar 14 of the chamber divider 10 and from there via the passage ports 34 in the annular wall 33 into the water distribution chamber 35. It emerges therefrom, without any separation between the water and air occurring, in the form of soft jets via the plurality of annular clearances 32 in the holes 9 in the perforated plate 8.

If a hard-jet operation of the hand shower is wanted, the two-way valve cone 17 is moved upwardly, tilting the actuating member 27, and is placed against the valve seat designed on the valve seat part 18. The water now flows from the admission chamber 4 through the radial channel 16 into the wider zone of the stepped hole 15 and from there via the narrower zone of the stepped hole 15 into the upper water distribution chamber 25. From there it emerges from the perforated plate 9 via the internal holes 31 in the flow sleeves 50 in the form of hard jets which are not mixed with air.

Figure 3:
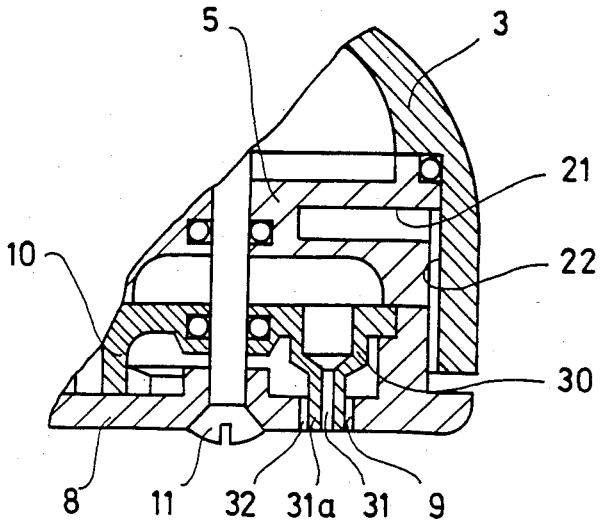
FIG. 3 shows an enlarged detail of FIG. 2.

The exemplified embodiment of a hand shower shown in FIG. 4 is largely identical with that described above with reference to FIGS. 1 to 5. Therefore, only those features in which the two exemplified embodiments differ from each other will be described in detail hereinafter. The elements of the exemplified embodiment shown in FIG. 4 which correspond to those of the exemplified embodiment shown in FIGS. 1 to 3 are marked with the same reference symbols plus 100.

Figure 4:
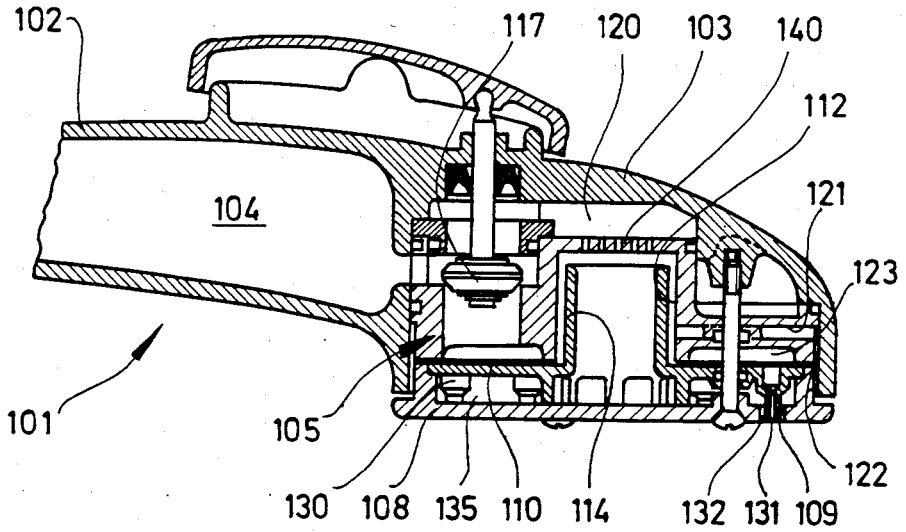
FIG. 4 shows a section, similar to that of FIG. 2, through a second exemplified embodiment of the invention.

Whilst, in FIG. 2, the device enriching the water with air was the central standard air bubbler 13 introduced into the stepped hole 12, the central hole 112 in the insert 105 has been designed as a downwardly open blind hole in FIG. 4. Towards the top, the blind hole 112 is covered by an integral zone of the insert 105 which is designed as a perforated plate 140. The collar 114 of the chamber divider 110 has been drawn, as a cylindrical neck, far to the top into the blind hole 112; it ends a short distance from the perforated plate 140.

When, in the soft-jet operation of the shower, the water flows through the perforated plate 140 via the admission chamber 120, it is split, in a similar manner as in a sieve, into a plurality of partial flows. With these partial flows there is mixed, due to the injector effect of the collar 114, air which is fed via the air suction channel 121 and the annular clearance 122. As in the first exemplified embodiment, the 'bubbling' water is fed to the water distribution chamber 135 located beneath the chamber divider 110 and emerges via the annular clearances 152 in the perforated plate 108.

I claim:

1. A shower provided with a housing, which terminates in a bell-shaped end part covered by a perforated plate, and with a change-over device for optional hard-jet or soft-jet operation and with a device which, in the soft-jet operation enriches the water with air, (a) a water flow-diverting device (17; 117) that diverts the inflowing water to one of two completely separated water paths;

(b) each water path incuding a water distribution chamber (23, 35; 123, 135) which covers areas which are substantially parallel to the portions of the perforated plate (8, 108);

(c) each water distribution chamber (23, 35; 123, 135) being in communication with a separate set of fluid outlet ports (31, 32; 131, 132) in said perforated plate (8; 108);

(d) a device (13; 140) for enriching the water with air being arranged substantially centrally in the path of the water for the soft-jet operation at a point upstream of the soft-jet water distribution chamber (35; 135) and occupies only a small area compared to the area of the perforated plate (8; 108), (e) a first of said two water distribution chambers (35; 135) directly adjoining the perforated plate (8; 108), and a second of said two water distribution chambers (23; 123) being separated from the first water distribution chamber (35; 135) by a chamber divider (10; 110) and being located at a distance spaced from the perforated plate (8; 108), and a plurality of flow sleeves (31; 130) are provided which pass through the first water distribution chamber and establish a connection between said second water distribution chamber (23; 123) and the outside of the perforated plate (8; 108).

2. A shower as set forth in claim 1 wherein said flow sleeves (30; 130) are integrally formed with the chamber divider (10; 110).

3. A shower as set forth in claim 1 wherein the flow sleeves (31; 130) project, with a free end, respectively into a hole (9; 109) in the perforated plate (8; 108), the diameter of the free end (31*a*) being smaller than the diameter of the hole (9; 109) in the perforated plate (8; 108) so that there comes about inside the hole (9; 109) in the perforated plate (8; 108) an annular clearance (32; 132) via which water can emerge from the first water distribution chamber (35; 135).

4. A shower as set forth in claim 2 wherein the flow sleeves (31; 130) project, with a free end, respectively into a hole (9; 109) in the perforated plate (8; 108), the diameter of the free end (31*a*) being smaller than the diameter of the hole (9; 109 in the perforated plate (8; 108) so that there comes about inside the hole (9; 109) in the perforated plate (8; 108) an annular clearance (32; 132) via which water can emerge from the first water distribution chamber (35; 135).

5. A shower as set forth in claim 1 wherein the chamber divider (10) is supported on the perforated plate (8) via a centrally located annular wall (33) that is provided with several fluid passage ports (34).

6. A shower as set forth in claim 2 wherein the chamber divider (10) is supported on the perforated plate (80 via a centrally located annular wall (33) that is provided with several fluid passage ports (34).

7. A shower as set forth in claim 3 wherein the chamber divider (10) is supported on the perforated plate (8) via a centrally located annular wall (33) that is provided with several fluid passage ports (34).

8. A shower as set forth in claim 1 wherein the device (13; 140) for enriching the water with air is arranged in a hole (12; 112) located in an insert (5; 105) and communicates via a radial air suction channel (21; 121) with an annular clearance (22; 122) between said insert (5; 105) and the housing (1; 101), which clearance, is in communication with the outside atmosphere.

9. A shower as set forth in claim 8 wherein the device enriching the water with air is a standard air bubbler (13).

10. A shower as set forth in claim 9 wherein the air bubbler (13) is supported by a cylindrical collar (14) of the chamber divider (10) which projects into the hole (12) in the insert (5).

11. A shower as set forth in claim 8 wherein the device enriching the water with air is a perforated section (140) which passes through the hole (112) in the insert (105).

12. A shower as set forth in claim 11 wherein the perforated section (140) is integral with the insert (105).

13. A shower as set forth in claim 11 wherein a cylindrical collar (14) of the chamber divider (110) projects into the hole (112) in the insert (105) and ends a short distance from the perforated plate (140).

* * * * *